US005257964A

United States Patent [19]

Petters

[11] Patent Number: 5,257,964

[45] Date of Patent: Nov. 2, 1993

[54] BARBELL FOR USE IN WEIGHT TRAINING

[76] Inventor: Oliver Petters, 16108 - 112 Street, Edmonton, Alberta, Canada, T5X 5V8

[21] Appl. No.: 894,615

[22] Filed: Jun. 5, 1992

[51] Int. Cl.[5] ..... A63B 21/00

[52] U.S. Cl. ..... 482/92; 482/93; 482/104; 403/377

[58] Field of Search ..... 482/104, 106, 107, 92, 482/93, 908, 138, 139, 41, 54; 403/109, 377, 378

[56] References Cited

U.S. PATENT DOCUMENTS

| | | | |
|---|---|---|---|
| 2,245,993 | 6/1941 | McCoy | 403/104 X |
| 2,470,815 | 5/1949 | Harvey | 482/104 X |
| 2,760,745 | 8/1956 | McCleery | 403/104 X |
| 3,756,597 | 9/1973 | Monti | 482/106 |
| 4,151,988 | 5/1979 | Nabinger | 482/54 |
| 4,360,198 | 11/1982 | Waulters | 482/139 X |
| 4,787,629 | 11/1988 | Demyer | 482/107 |
| 4,893,810 | 1/1990 | Lee | 482/107 |
| 4,978,122 | 12/1990 | Dibowski | 482/106 |

OTHER PUBLICATIONS

Advertisement by Wesley Bros. Health & Fitness Co. in a 1985 issue of Muscle & Fitness magazine p. 196.

*Primary Examiner*—Richard J. Apley
*Assistant Examiner*—Beverly A. Meindl
*Attorney, Agent, or Firm*—Anthony R. Lambert

[57] ABSTRACT

A barbell consisting of two elongate vertical members extending substantially vertically from base supports. A substantially horizontal member is secured between the vertical members. Weights are removably secured to the vertical members adjacent to the base supports.

2 Claims, 8 Drawing Sheets

BARBELL FOR USE IN WEIGHT TRAINING

The present invention relates to a barbell for use in weight training.

BACKGROUND OF THE INVENTION

The primary disadvantage in using barbells involves considerations of safety. For this reason a variety of weight training machines have been developed, as they provide a degree of safety that barbells presently do not provide. This safety factor is documented in a Sports Illustrated (trademark) publication entitled STRENGTH TRAINING Your Ultimate Weight Conditioning Program by John Garhammer on page 48;

> "As for safety, machines have some advantages over free weights. You can fall with a barbell, drop a dumbbell on yourself, or get stuck underneath a barbell when performing the bench press. These kinds of accidents should not happen if you use proper technique in your free weight exercises, handle reasonable weights, and use "spotters" during exercises such as the squat and bench press. But if you're not careful, these kinds of accidents can happen with free weights, while they're unlikely or impossible with machines."

Exercise machines tend to be more expensive than barbells, so many persons workout with barbells notwithstanding the potential for accidents. Invariably persons who have not mastered the proper techniques attempt barbell workouts when "spotters" are not available, so accidents involving barbells continue to occur.

SUMMARY OF THE INVENTION

What is required is a "safer" barbell.

According to the present invention there is provided a barbell which is comprised of two elongate vertical members extending substantially vertically from base supports. A substantially horizontal member is secure between the vertical members. Means is provided for securing weights t the vertical members adjacent to the base supports.

With the barbell as described above, a number of safety concerns are resolved. If the barbell is "dropped" while a person is weight training it merely falls back onto the base supports. The vertical members serve as "legs" which prevent the horizontal member from falling upon the person who has dropped the barbell. With all weight located adjacent the base supports, there is little likelihood of the described barbell configuration "tipping over".

Although beneficial results may be obtained through the use of the barbell as described, in order to accommodate the full range of exercises of a weight training program the horizontal member must be placed in different horizontal positions in relation to the vertical members. Even more beneficial results may, therefore, be achieved by having means to adjust the positioning of the horizontal member in relation to the vertical members.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
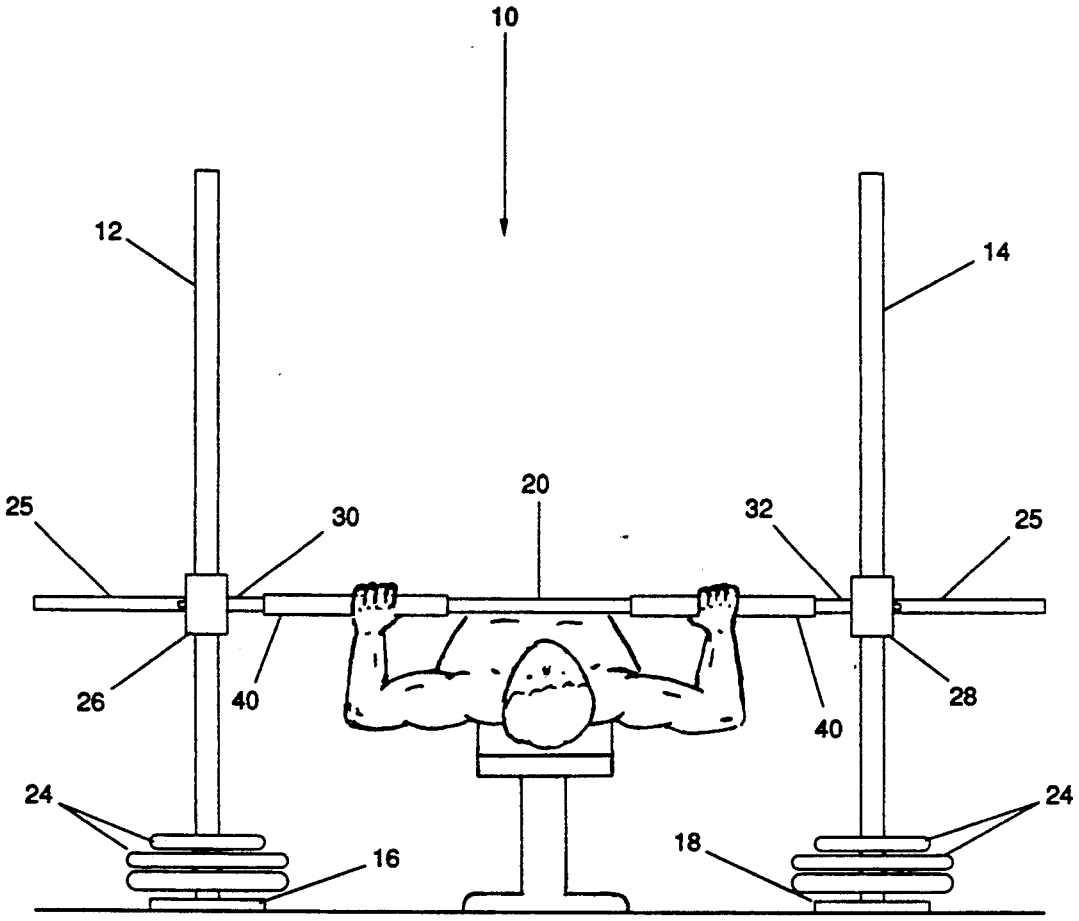
FIG. 1 is a front elevation view of a barbell constructed in accordance with the teachings of the present invention in a bench press setting with weights at rest.

The preferred embodiment, a barbell generally identified by reference numeral 10, will now be described with reference to FIGS. 1 through 8.

Figure 2:
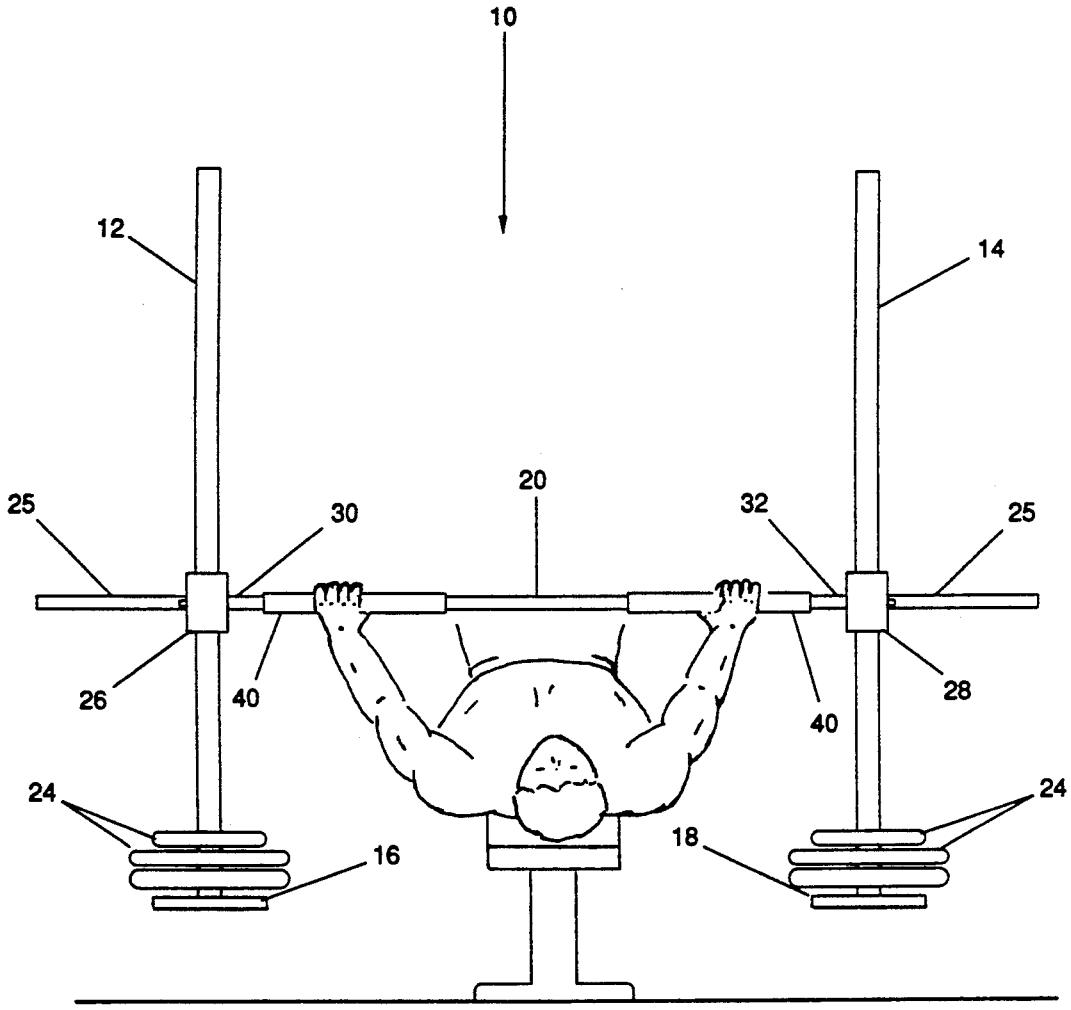
FIG. 2 is a front elevation view of a barbell constructed in accordance with the teachings of the present invention in a bench press setting with weights being used as resistance.
Figure 3:
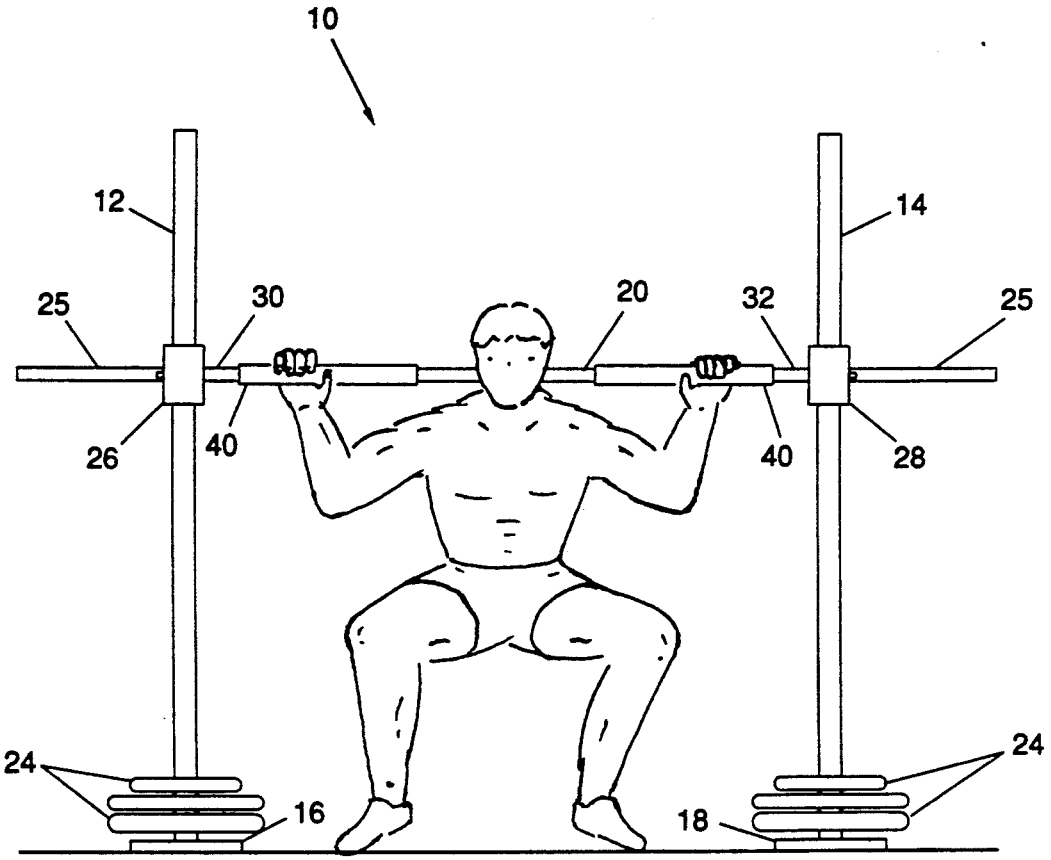
FIG. 3 is a front elevation view of a barbell constructed in accordance with the teachings of the present invention in a squat setting with weights at rest.
Figure 4:
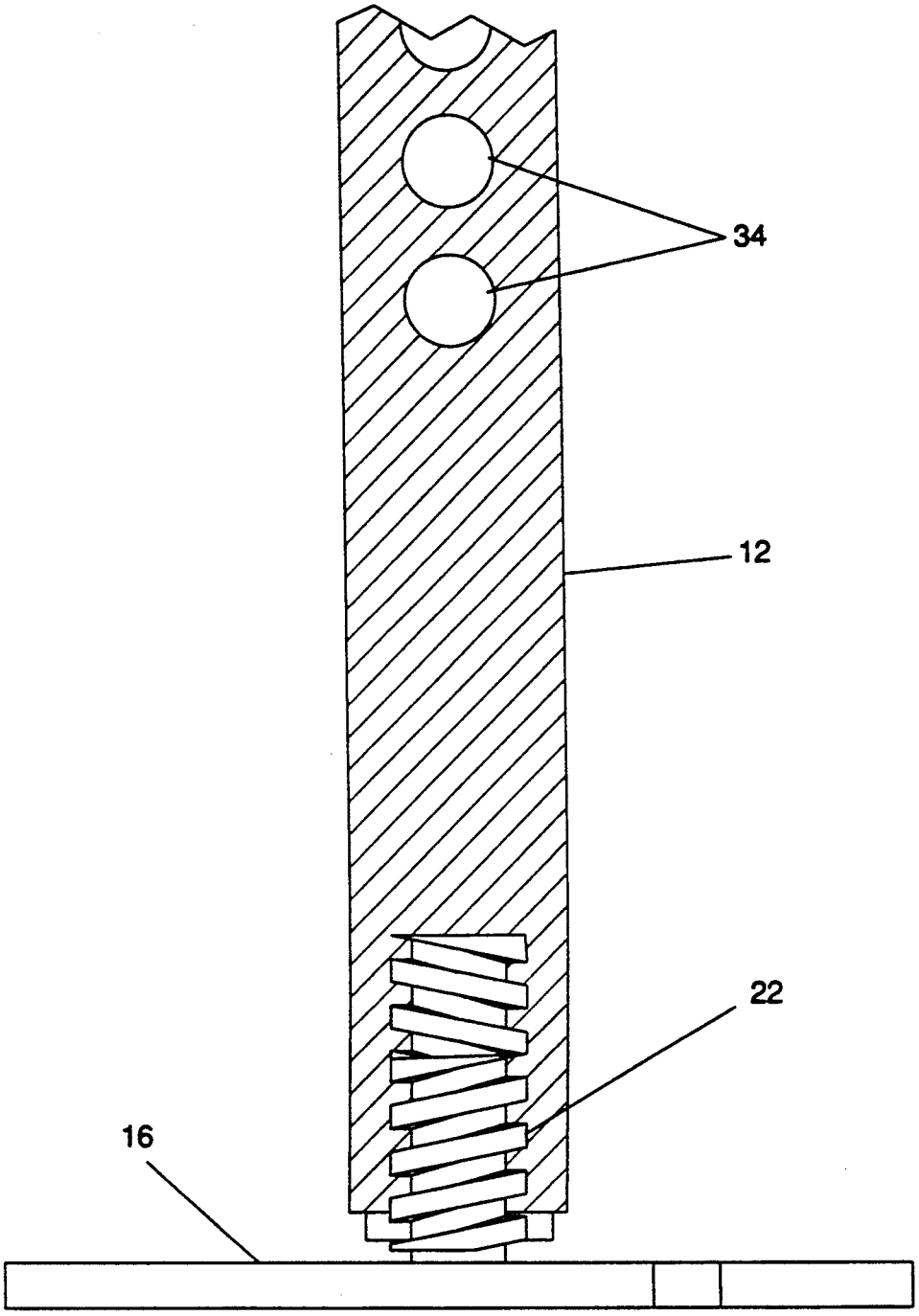
FIG. 4 is a section view of base support and vertical member of the barbell illustrated in FIG. 1.
Figure 6:
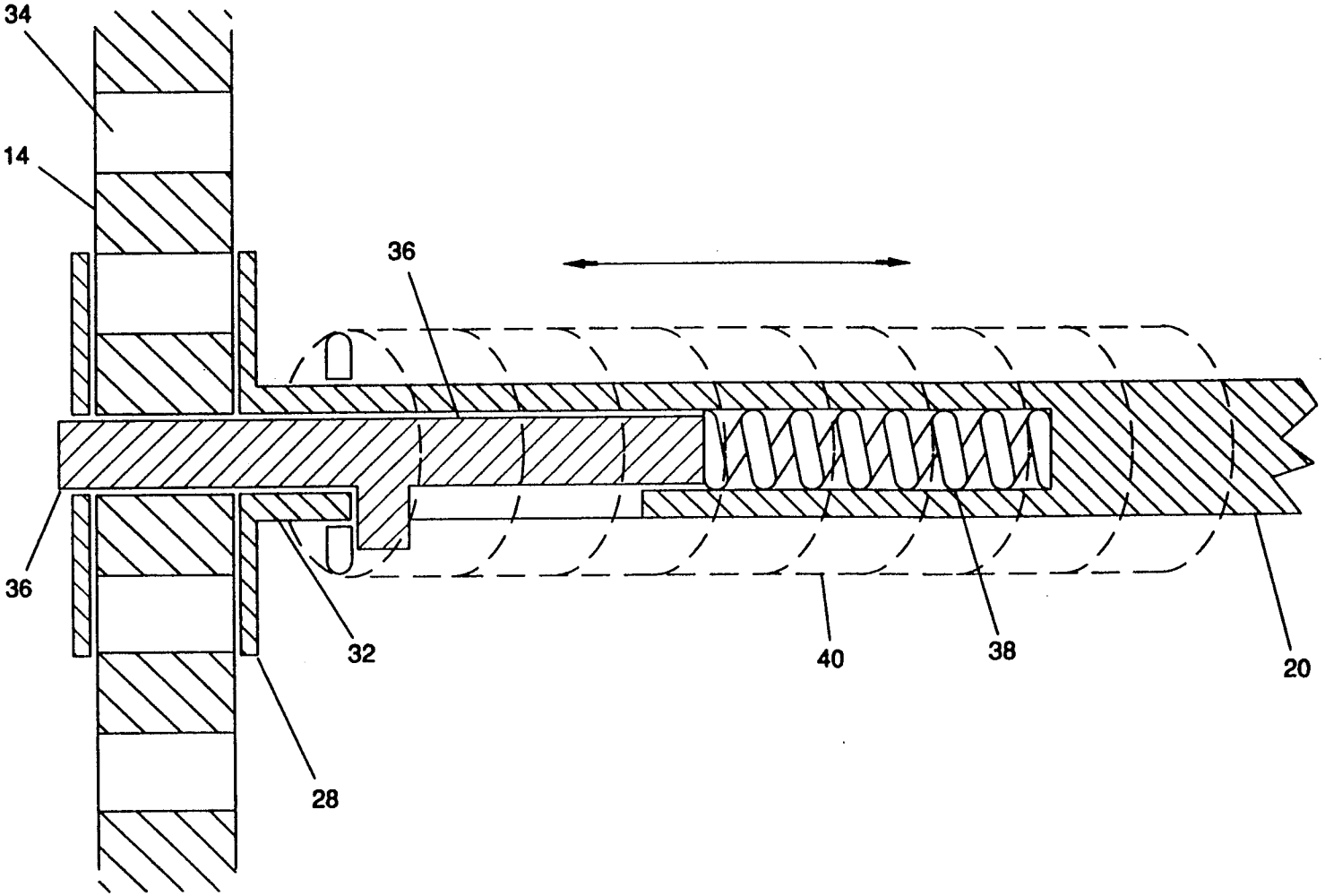
FIG. 6 is a section view of horizontal member and vertical member of the barbell illustrated in FIG. 1 with locking mechanism engaged.
Figure 7:
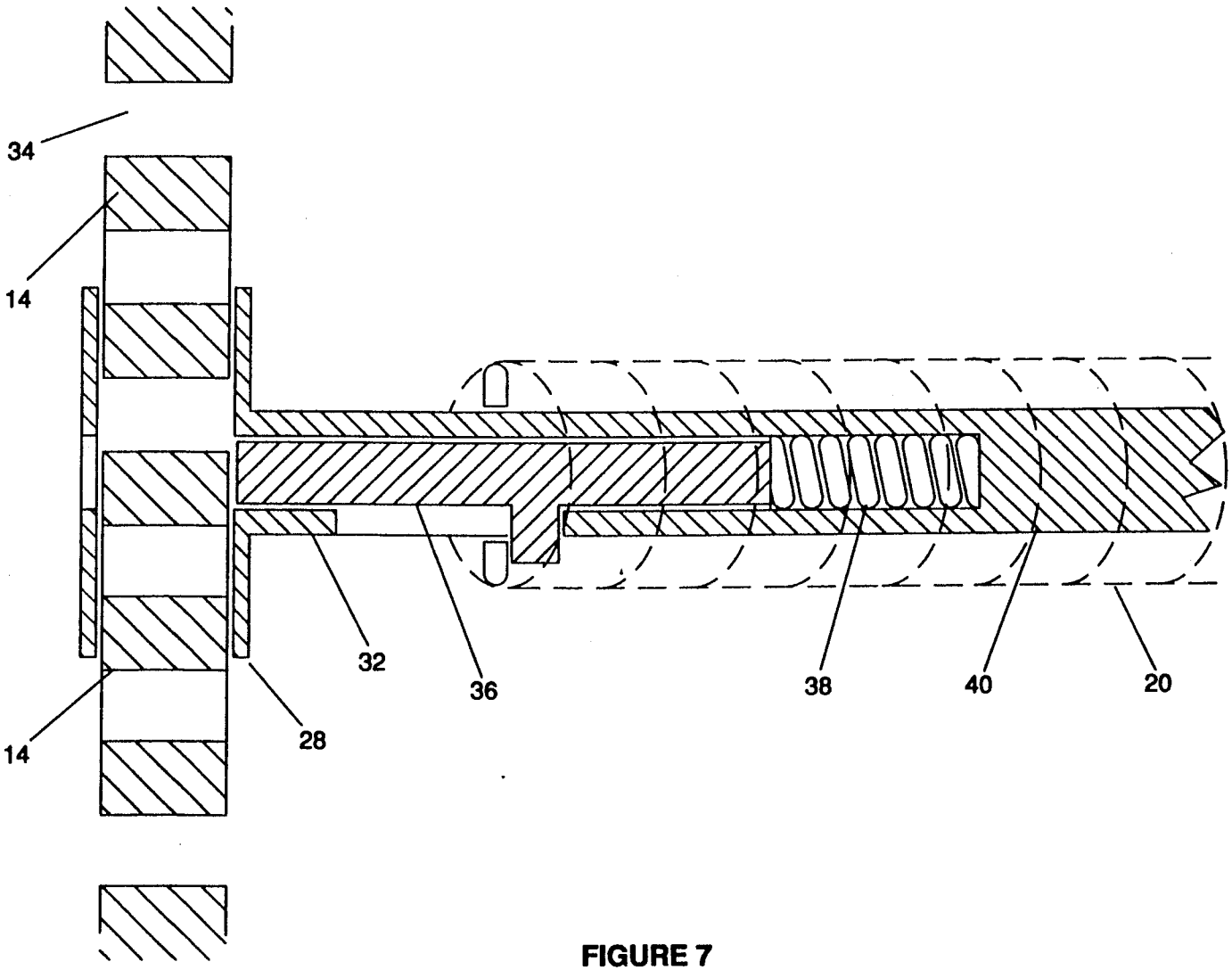
FIG. 7 is a section view of horizontal member and vertical member of the barbell illustrated in FIG. 1 with locking mechanism disengaged.

As illustrated in FIGS. 1 through 3, barbell 10 consists of two elongate vertical members 12 and 14 which extend substantially vertically from base supports 16 and 18, respectively. A substantially horizontal member 20 is secured between vertical members 12 and 14. Referring to FIG. 4, base supports 16 and 18 are threadedly coupled by a threaded connection, generally identified by reference numeral 22, to vertical members 12 and 14, respectively. Threaded connection 22 permits base supports 16 and 18 to be detachable from vertical members. When base supports 16 and 18 are repositioned on vertical members 12 and 14, as illustrated in FIGS. 1 through 3, base supports 16 and 18 serve as means for securing weights 24 to vertical members 12 and 14, respectively. Referring to FIGS. 6 and 7, further detail is provided with respect to the preferred means of attaching horizontal member 20 to vertical members 12 and 14. Horizontal member 20 has transverse sleeves 26 and 28 at ends 30 and 32, respectively, which telescopically receive vertical members 12 and 14, respectively. Stub-form end extensions 25 project past transverse sleeves 26 and 28. Each of vertical members 12 and 14 have a plurality of female fastening receptacles 34 spaced at intervals along their length. Horizontal member 20 has male fastening members 36 at each of ends 30 and 32. Each of male fastening members 36 are aligned coaxially with horizontal member 20 and biased by a spring 38 into an extended position wherein male fastening members 36 extend into transverse sleeves 26 and 28. Horizontal member 20 has slidable hand grips 40 which are secured to male fastening members 36.

Figure 8:
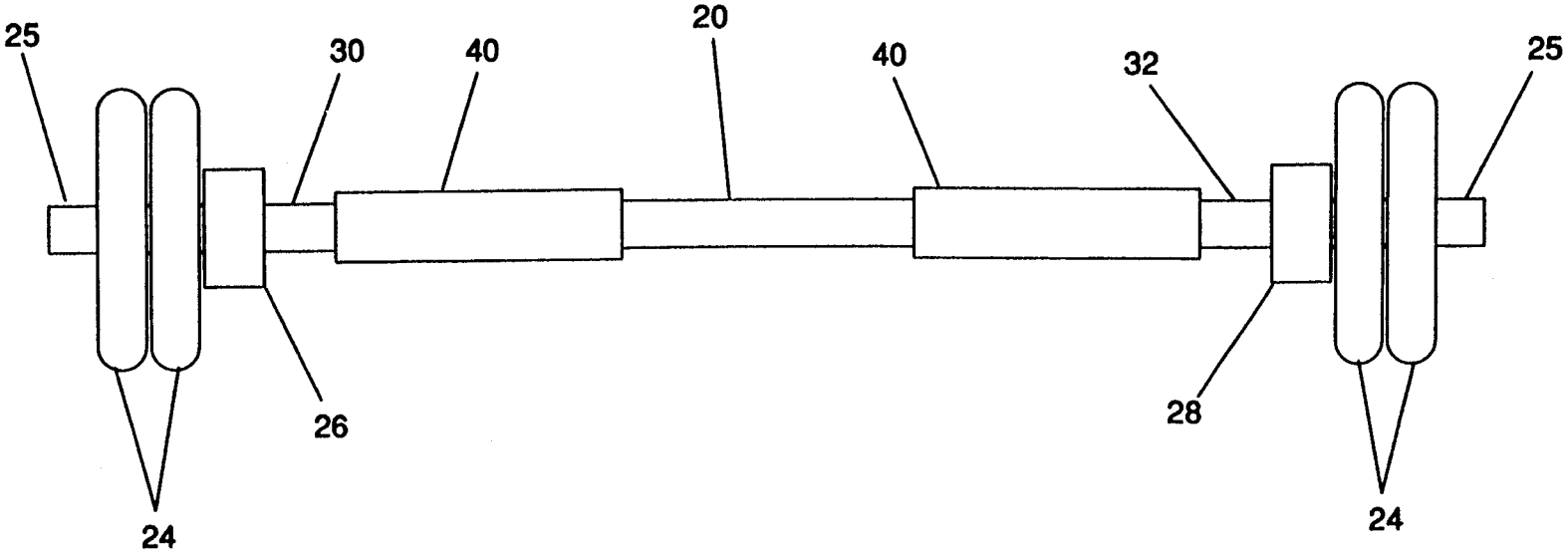
FIG. 8 is a side elevation view of the barbell illustrated in FIG. 1, with the supporting structure of vertical members removed permitting the horizontal member to be used in the manner of a conventional barbell.

The use and operation of barbell 10 will now be described with reference to FIGS. 1 through 8. In order to use barbell 10, the user temporarily detaches horizontal member 20 from vertical members 12 and 14. With horizontal member 20 removed weights 24 may be slid down vertical members 12 and 14 until weights 24 rest upon base supports 16 and 18, respectively. FIG. 1 illustrates the user performing a bench press exercise. When performing a bench press the user pushes on horizontal member 20, working against the resistance provided by weights 24, as illustrated in FIG. 2. If the user encounters difficulty during the exercise, he can permit the barbell to drop, as it will merely fall a short distance back onto base supports 16 and 18. In order to perform other exercises, such as a squat, horizontal member 20 must be moved to a different horizontal position in relation to vertical members 12 and 14. FIG. 3 illustrates the desired positioning for performing a half squat. In order to move horizontal member 20, the user overcomes the biasing force exerted by spring 38 upon male fastening members 36 through a manual manipulation of slidable hand grips 40. By pressing slidable hand grips 40 toward each other, male fastening members 36 are moved to a retracted position wherein male fastening members 36 are retracted from transverse sleeves 26 and 28, as illustrated in FIG. 7. When male fastening members 36 are moved to a retracted position, they are withdrawn from female fastening receptacles 34 permitting transverse sleeves 26 and 28 to telescopically move along vertical members 12 and 14, respectively. When the desired height for horizontal member 20 is reached, the manual pressure being exerted through slidable hand grips 40 to overcome the biasing force of spring 38 is released, permitting male fastening members 36 to return to the extended position wherein male fastening members 36 extend into transverse sleeves 26 and 28. As male fastening members 36 move to the extended position they are inserted into one of the female fastening receptacles 34 thereby securing horizontal member 2 to vertical members 12 and 14. The positioning of female fastening receptacles 34 will not be ideally suited for all exercises. A "fine" adjustments may be made the height of horizontal member 20 relative to an anatomy of a person (not shown) by rotating base supports 16 and 18 thereby effecting an incremental change to the height of vertical members 12 and 14. An example where this feature is useful is with the bench press, as illustrated in FIGS. 1 and 2. The fine adjustment can place horizontal member 20 a fraction of an inch above the chest of the person performing the exercise. It will be appreciated that where safety considerations do not dictate the need for "spotting", barbell 10 can be used as a conventional barbell by placing weights 24 on Stub-form end extensions 25, as illustrated in FIG. 8.

It will be apparent to one skilled in the art that barbell 10 is a safer barbell configuration, and in addition provides other advantages. Barbell 10 can hold more weights 24 than other barbells. In the bench press removing the barbell from supporting uprights places the shoulders in a vulnerable position. This potential injury is prevented with barbell 10 as the line of action is vertical.

Figure 5:
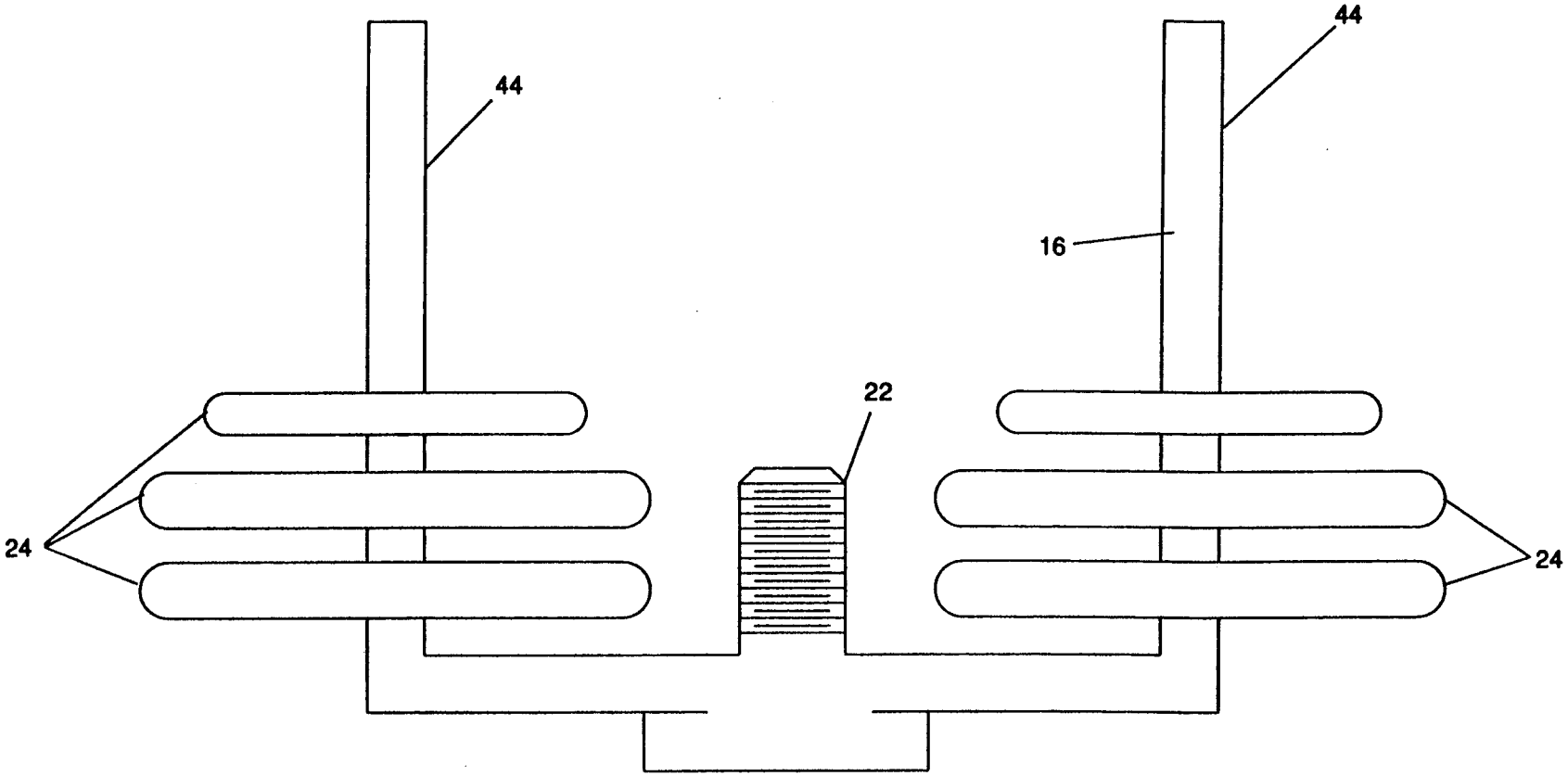
FIG. 5 is an alternate base support configuration.

It will also be apparent to one skilled in the art that modifications may be made to the illustrated embodiment without departing from the spirit and scope of the invention as defined by the claims. In particular, there are various means of mounting weights 24 to vertical members 12 and 14. FIG. 5 illustrates one of these alternative means, in this embodiment base supports 16 and 18 are modified to have a weight supporting portion 44. It will also be apparent to one skilled in the art that there are numerous alternative means of attaching horizontal member 20 to vertical members 12 and 14. It will also be apparent that there are alternative ways of placing weights 24 in position. Base supports 16 and 18 may be detached at threaded connection 22 from vertical members 12 and 14, respectively. The user may then slides weights 24 onto vertical members 12 and 14 to obtain the desired weight training resistance, and reattach base supports 16 and 18.

The embodiments of the invention in which an exclusive property or privilege is claimed are defined as follows:

1. A barbell, comprising:

a. two elongate vertical members extending substantially vertically from base supports;

b. a substantially horizontal member removably secured between the vertical members, such that upon removal of the horizontal member weights are slid down the vertical members until the weights rest upon the base supports;

c. the horizontal member having transverse sleeves at each end which telescopically receive the vertical members, each of the vertical members having a plurality of spaced female fastening receptacles, spring biased male fastening members are aligned coaxially with the horizontal member and biased into an extended position wherein the male fastening members extend into the transverse sleeves, the horizontal member has slidable hand grips which are secured to the male fastening members, by overcoming the biasing force upon the male fastening members through the manual manipulation of the slidable hand grips the male fastening members are movable to a retracted position wherein the male fastening members are retracted from the transverse sleeves, the male fastening members are inserted into a selected pair of the female fastening receptacles thereby serving as means to adjust the positioning of the horizontal member in relation to the vertical members;

d. stub-form end extensions being secured to and projecting outwardly from each of the transverse sleeves, thereby providing an alternative weight mounting position; and e. the base supports being threadedly coupled to the vertical members, such that fine vertical adjustments may be made to the height of the horizontal member relative to an anatomy of a person by rotating the base supports thereby effecting an incremental change to the height of the vertical members.

2. A barbell, comprising:

a. two elongate vertical members extending substantially vertically from base supports;

b. a substantially horizontal member removably secured between the vertical members, such that upon removal of the horizontal member weights are slid down the vertical members until the weights rest upon the base supports;

c. the horizontal member having transverse sleeves at each end which telescopically receive the vertical members, each of the vertical members having a plurality of spaced female fastening receptacles, spring biased male fastening members are aligned coaxially with the horizontal member and biased into an extended position wherein the male fastening members extend into the transverse sleeves, the horizontal member has slidable hand grips which are secured to the male fastening members, by overcoming the biasing force upon the male fastening members through the manual manipulation of the slidable hand grips the male fastening members are movable to a retracted position wherein the male fastening members are retracted from the transverse sleeves, the male fastening members are inserted into a selected pair of the female fastening receptacles thereby serving as means to adjust the positioning of the horizontal member in relation to the vertical members.

* * * * *